US008613203B2

(12) United States Patent
Kim

(10) Patent No.: US 8,613,203 B2
(45) Date of Patent: Dec. 24, 2013

(54) REFRIGERATOR AND CONTROL METHOD THEREOF

(75) Inventor: Sung Kyoung Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 910 days.

(21) Appl. No.: 12/740,257

(22) PCT Filed: Nov. 4, 2008

(86) PCT No.: PCT/KR2008/006498

§ 371 (c)(1),
(2), (4) Date: Apr. 28, 2010

(87) PCT Pub. No.: WO2009/061119

PCT Pub. Date: May 14, 2009

(65) Prior Publication Data

US 2010/0257875 A1 Oct. 14, 2010

(30) Foreign Application Priority Data

Nov. 5, 2007 (KR) ..... 10-2007-0111951

(51) Int. Cl.
*F25C 1/00* (2006.01)

(52) U.S. Cl.
USPC ..... 62/66; 62/340

(58) Field of Classification Search
USPC ..... 62/66, 74, 129, 157, 340, 344, 389, 447
See application file for complete search history.

(56) References Cited

U.S. PATENT DOCUMENTS

| | | | | | |
|---|---|---|---|---|---|
| 4,909,039 | A | * | 3/1990 | Yamada et al. | 62/66 |
| 5,697,222 | A | * | 12/1997 | Lee | 62/66 |
| 5,737,932 | A | | 4/1998 | Lee | |
| 5,836,168 | A | | 11/1998 | Lee | |

FOREIGN PATENT DOCUMENTS

| | | | |
|---|---|---|---|
| CN | 1153278 | A | 7/1997 |
| CN | 2539113 | Y | 8/2011 |
| JP | 6-011221 | A | 1/1994 |
| JP | 9-222275 | A | 8/1997 |
| JP | 11-304323 | A | 11/1999 |
| JP | 2002-295931 | A | 10/2002 |
| KR | 10-1997-0028324 | A | 6/1997 |
| KR | 20-1998-018117 | A | 7/1998 |
| KR | 20-0126839 | Y1 | 11/1998 |
| KR | 10-0168184 | B1 | 1/1999 |
| KR | 10-1999-0034645 | A | 5/1999 |
| KR | 10-0180818 | B1 | 5/1999 |
| KR | 10-2001-0020786 | A | 3/2001 |
| KR | 10-2006-0068745 | A | 6/2006 |

* cited by examiner

*Primary Examiner* — Melvin Jones
(74) *Attorney, Agent, or Firm* — Birch, Stewart, Kolasch & Birch, LLP

(57) ABSTRACT

Provided are a refrigerator and a control method thereof. Various sized mineral water bottles that is generally available everywhere may be used as a water supply container. When water lack state occurs in a water supply process, a water supplement signal is outputted to allow a user to detect the water lack state, as well as, the user can quickly and easily replace the water supply container.

7 Claims, 6 Drawing Sheets

REFRIGERATOR AND CONTROL METHOD THEREOF

TECHNICAL FIELD

The present disclosure relates to a refrigerator and a control method thereof.

BACKGROUND ART

In general, a refrigerator is a home appliance that can store foods at low temperatures in an inside storage space shielded by a refrigerator door. In detail, the refrigerator can store the foods at an optimum state by cooling the storage space using cooling air generated through heat exchange with refrigerant changed to low temperature and low pressure conditions in cooling cycle.

The size of the refrigerator tends to increase more and more and multi-functions are provided to the refrigerator as dietary life changes and pursues high quality, and accordingly, refrigerators having various structures and convenient devices with consideration of user convenience are brought to the market.

Representative examples of the convenient devices include an ice making device for making ice and a dispenser. The ice making device and the dispenser for providing the ice or water to a user may be disposed in the refrigerator and the refrigerator door.

The ice making device generally uses a method in which water is directly filled in a tray for making the ice or a method in which the water is filled in a water supply container having water capacity for making the ice once, and then the water supply container is fitted to supply the water stored in the water supply container to the tray for making the ice.

However, in such a structure, the ice making device can make ice only once. If the water supply container having a large capacity is used, water within the water supply container is frozen due to the nature of a temperature of a freezing compartment. As a result, it is impossible to continuously perform a proper function of the ice making device.

To solve the above-described limitation, a refrigerator in which a water supply line is directly connected to a water pipe to continuously drive the ice making device, as well as the water supply is connected to the dispenser to dispense drinking water through the dispenser has been developed.

Since the refrigerator having such a structure uses the water pipe as a water source, the water supply line connected to the water pipe must be required. Thus, the refrigerator must be disposed adjacent to the water pipe, or a relative long water supply line must be provided. As a result, installation costs of the refrigerator increases, and also an installation place of the refrigerator is limited.

A refrigerator in which a water supply container is disposed in a refrigerating compartment, a water supply container and an ice tray within the refrigerating compartment are connected to a water supply pipe, and water within the water supply container is guided to the ice tray via the water supply pipe by a pump inside the water supply container is disclosed in Korean Granted Patent No. 10-0346975.

In such a structure, an auxiliary water supply container is disposed in the refrigerating compartment, and the wafer for making ice is continuously supplied into the ice tray to continuously make the ice without requiring a direct connection to a water pipe.

A refrigerator in which a mineral water bottle is seated in an upside-down to supply water into a water tank, and the water is dispensed through a dispenser communicating with the water tank to the outside is disclosed in Korean Laid-open Patent No. 10-2006-0068745.

In such a structure, the water of the bottle disposed in a refrigerator door is dispensed into the dispenser without requiring a direct connection to a water pipe. As a result, the dispenser can perform their proper function.

DISCLOSURE OF INVENTION

Technical Problem

Embodiments provide a refrigerator in which an opening of a mineral water bottle can be disposed upwardly to prevent water from being dispersed in a water supply container replacement process.

Embodiments also provide a control method of a refrigerator in which a user can immediately recognize a time point of a water supply replacement in a water supply process, as well as, the user easily replace a water supply container.

Technical Solution

In one embodiment, a refrigerator includes: a controller; an ice making device disposed in a storage space of the refrigerator or a door shielding the storage space; a water supply container detachably disposed in the storage space or the door; a water supply passage fluidly connecting the water supply container to the ice making device; a detecting unit disposed in the ice making device to determine whether a set flow amount of water is supplied into the ice making device; and a sensing unit disposed inside or outside the water supply container to determine whether water remains in the water supply container.

In another embodiment, a control method of a refrigerator, the method includes: generating an ice making water supply signal or a drinking water supply signal; driving a pump by the water supply signal; supplying water from a water supply container to an ice making device or a water dispenser by driving the pump; and generating a signal that instructs water supplement into the water supply container when a water lack state is detected before water supply is completed.

In a further embodiment, a control method of a refrigerator, the method includes: generating a water supply signal for ice making; driving a pump to supply water stored in a water supply container into an ice making device; periodically detecting a water level of the ice making device and a water level of the water supply container; and stopping the pump driving when the water level of the water supply container becomes lower than a set water level before the water level of the ice making device reaches to the set water level.

In a still further embodiment, a control method of a refrigerator, the method includes: generating water supply signal for ice making; driving a pump to supply water stored in a water supply container into an ice making device; periodically detecting flow amount of water supplied into the ice making device and water level of the water supply container; and stopping the pump driving when the water level of the water supply container becomes lower than a set water level before the flow amount of the water supplied into the ice making device reaches to the set water level.

In an even further embodiment, a control method of a refrigerator, the method includes: generating a water supply signal for ice making; driving a pump to supply water stored in a water supply container into an ice making device; periodically detecting flow amount of water supplied into the ice making device and a state of a flow switch disposed in a water supply passage extending from the water supply container to the ice making device; and stopping the pump driving when the flow switch turns off before the flow amount of the water supplied into the ice making device reaches to a set flow amount.

In a yet further embodiment, a control method of a refrigerator, the method includes: generating a water supply signal for ice making; driving a pump to supply water stored in a water supply container into an ice making device; periodically detecting a water level of the ice making device and a state of a flow switch disposed in a water supply passage extending from the water supply container to the ice making device; and stopping the pump driving when the flow switch turns off before the water level of the ice making device reaches to a set level.

Advantageous Effects

According to a refrigerator and a control method thereof according to an embodiment, various sized mineral water bottles that is generally available everywhere may be used as a water supply container. In addition, when water lack state occurs in a water supply process, a water supplement signal is outputted to allow a user to detect the water lack state, as well as, the user can quickly and easily replace the water supply container.

MODE FOR THE INVENTION

Reference will now be made in detail to the embodiments of the present disclosure, examples of which are illustrated in the accompanying drawings. The spirit and scope of the present disclosure, however, shall not be construed as being limited to embodiments provided herein. Rather, it will be apparent that other embodiments that fall within the spirit and scope of the present disclosure may easily be derived through adding, modifying, and deleting elements herein.

Hereinafter, a side by side type refrigerator in which a freezing compartment and a refrigerating compartment are disposed at left and right sides, respectively, will be described as an example. However, the present disclosure is not limited thereto. For example, a top mount type refrigerator in which the freezing compartment is disposed over the refrigerating compartment or a bottom freezer type refrigerator in which the freezing compartment is disposed under the refrigerating compartment may be applied.

Figure 1:
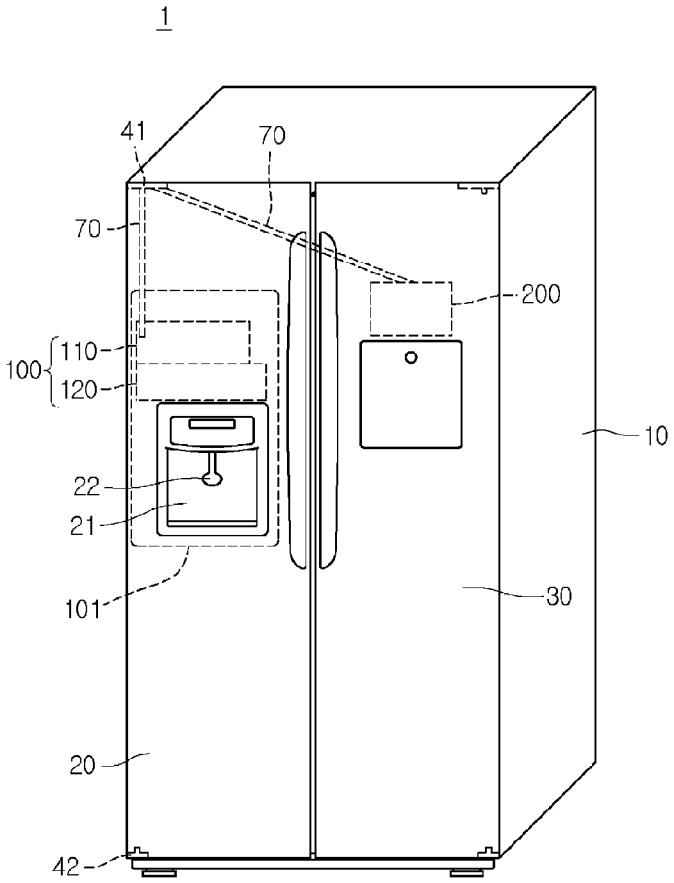
FIG. 1 is a perspective view of a refrigerator including a water supply unit according to an embodiment.
Figure 2:
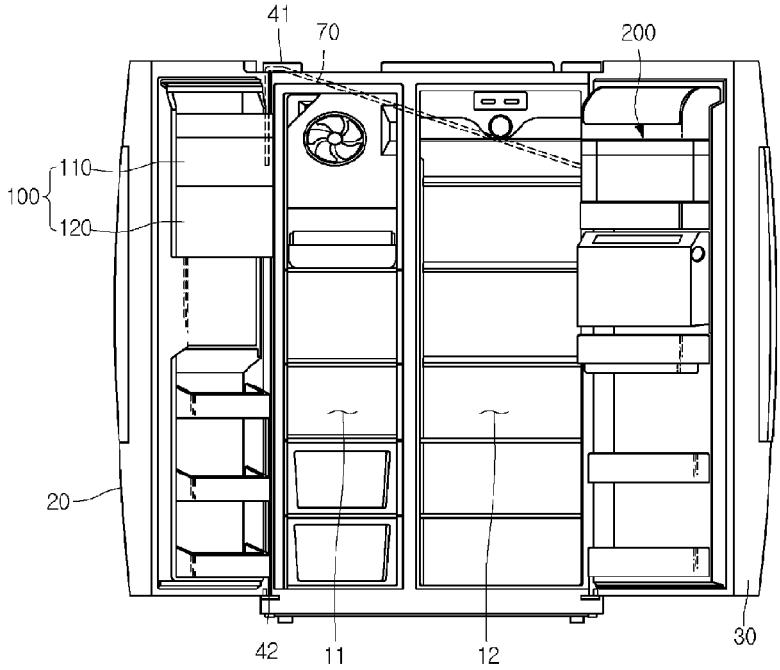
FIG. 2 is a front view illustrating an inner structure of a refrigerator according to an embodiment.

FIG. 1 is a perspective view of a refrigerator including a water supply unit according to an embodiment, and FIG. 2 is a front view illustrating an inner structure of the refrigerator according to an embodiment.

Referring to FIGS. 1 and 2, a refrigerator 1 includes a body 10, a freezing compartment door 20, and a refrigerating compartment door 30. A freezing compartment 11 and a refrigerating compartment 12 containing cooling air are disposed in the body 10. The freezing compartment door 20 and the refrigerating compartment door 30 are pivotally installed on a front surface of the body 10 to selectively open and close the freezing compartment 11 and the refrigerating compartment 12, respectively.

In detail, hinge parts 41 and 42 are coupled to upper and lower portions of each of doors 20 and 30. The hinge parts 41 and 42 allow the doors 20 and 30 to be rotated with respect to the body 10.

An ice making device 100 making ice and storing the ice may be disposed in the freezing compartment 11. Since the freezing compartment is defined by an inner space of the body 10 and a back surface of the freezing compartment door 20, the freezing compartment door 20 substantially constitutes a portion of the freezing compartment 11. Thus, disposing the ice making device 100 in the freezing compartment 11 should be considered in case where the ice making device 100 is disposed inside the freezing compartment 11 and in case where the ice making device 100 is disposed in the freezing compartment door 20.

The ice making device 100 includes an ice maker 110 and an ice bank 120. The ice making device 100 will be now described in detail. The ice maker 110 includes an ice tray in which a plurality of cubes for making ice is arranged.

An insulation case 101 may be disposed on outer surface of the ice making device 100 to separate the ice making device 100 from cooling air of the freezing compartment 11. A cooling air supplied from an evaporator (not shown) may be transferred into the ice making device 100 through an additional cooling air passage. Since the cooling air within the freezing compartment 11 is not introduced into the ice making device 100 due to the insulation case 101, it prevents food smell within the freezing compartment 11 from being introduced into the ice making device 100, whereby to obtain hygienic ice.

A dispenser 21 is disposed in the freezing compartment door 20. The ice stored in the ice bank 120 is discharged into the dispenser 21 through an ice discharging duct (not shown) for discharging the ice. A manipulation lever 22 is disposed in the dispenser 21 to discharge the ice by user's manipulation.

A water supply unit 200 may be disposed in the refrigerating compartment door 30. In detail, the water supply unit 200 is connected to the ice making device 100 through a water supply passage 70. A pump (that will be described later) for pumping water stored in the water supply unit 200 into the water supply passage 70 may be provided. The pump may be one of components constituting the water supply unit 200.

The water supply unit 200 is disposed in the door to sufficiently secure a food storage space of the refrigerating compartment 12. A capacity of water stored in a water tank (that will be described later) is determined according to a size of the water supply unit 200. That is, if the size of the water supply unit 200 increases, an acceptable size of the water tank increases to increase the capacity of the stored water. The water supply unit 200 and the pump will not be described with reference to the accompanying drawings.

The water supply passage 70 may be disposed around by the refrigerating compartment 11. This is done because the water within the water supply passage 70 may be frozen in case where the water supply passage 70 is disposed via the refrigerating compartment 11.

Thus, the water supply passage 70 is disposed around by the refrigerating compartment 11 to prevent the water within the water supply passage 70 from being frozen. If an insulation member for preventing heat from being transmitted to an outer circumference surface of the water supply passage 70 is provided, the water supply passage 70 may be disposed via the refrigerating compartment 11.

Also, the water supply passage 70 may be disposed via an outside of the body 10. Since the water supply passage 70 is disposed via the outside of the body 10, the water supply passage 70 may be easily replaced from the outside when the inside of the water supply passage 70 is polluted by the water. Thus, the user can eat hygienic ice.

In case where the water supply passage 70 is disposed outside the body 10, the water supply passage 70 may be connected to the ice maker 110 via the upper hinge part 41. A hole through which the water supply passage 70 passes may be defined in the upper hinge part 41. In this case, since the upper hinge part 41 is a rotational center of the door 20, the water supply passage 70 does not have an effect on rotation of the door 20.

The water supply passage 70 may be buried in the refrigerating compartment door 20. This is done for reasons that do not expose the water supply passage 70 to the outside and the cooling air of the freezing compartment.

Also, the water supply passage 70 connected to the pump (that will be described later) may be disposed via a back surface 15 and a top surface 16 of the body 10. Thus, a length of the water supply passage 70 may be reduced. In this case, the water supply passage 70 may be disposed such that the user does not see the water supply passage 70. A recess in which the water supply passage 70 is seated may be disposed in the back and top surfaces 15 and 16 of the body 10. The recess may be formed by a press working when an outward appearance of the body 10 is manufactured.

A cover covering a bent portion of the water supply passage 70 may be coupled to a portion through which the water supply passage 70 passes through the back surface 15 of the body 10. The portion through which the water supply passage 70 passes may be sealed by a sealing member such that the cooling air within the refrigerator does not leak out.

A coupling (not shown) may be coupled to a portion at which the water supply passage 70 is exposed to the outside of the refrigerator and a portion at which the water supply passage 70 is buried in the body 10 or the doors 20 and 30. The portion at which the water supply passage 70 is exposed to the outside and the portion at which the water supply passage 70 is buried are easily coupled by the coupling. In this case, the portion at which the water supply passage 70 is exposed to the outside may be easily replaced and repaired.

Figure 3:
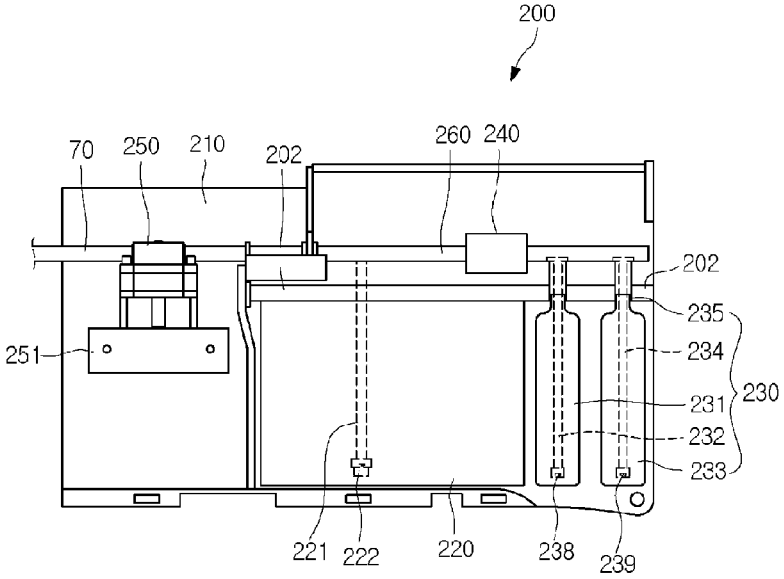
FIG. 3 is a perspective view of a water supply unit according to an embodiment.

FIG. 3 is a perspective view of the water supply unit according to an embodiment.

Referring to FIG. 3, the water supply unit 200 according to the first embodiment includes first, second, and third water supply containers 220, 231, and 233, a container connecting part 202, a pump 250, a connecting passage 260, and a housing 210. The first, second and third water supply containers 220, 231, and 233 store water to be supplied into the ice making device 100. The container connecting part 202 connects the water supply containers 220, 231, and 233 to the water supply unit 200. The pump 250 pumps the water stored in the water supply containers 220, 231, and 233 into the ice making device 100. The connecting passage 260 supplies the water pumped from the water supply containers 220, 231, and 233 into the ice making device 100. The housing 210 defines an external appearance of the water supply unit 200 and allows the water supply containers 220, 231, and 233 and the pump 250 to be coupled to the refrigerator door. The container connecting part 202 may be a portion the housing 210.

In detail, the water supply unit 200 may have approximately a rectangular parallelepiped shape. The water supply unit 200 may be long in a horizontal direction and relatively short in width in width in front and rear directions such that the water supply unit 200 is coupled to the refrigerating compartment door 30.

The first water supply container 220 serves as a main water supply container of the water supply unit 200 and may be detachably coupled to the housing 210. The user can separate the first water supply container 220 from the housing 210 in order to store the water in the first water supply container 220 or wash the inside of the first water supply container 220. A detachable cover tank (not shown) for containing the water may be disposed on an top surface of the first water supply container 220.

A first suction passage 221 is fluidly connected to the connecting passage 260 to supply the water within the first water supply container 220 into the connecting passage 260. The first suction passage 221 may extend from an end portion of the connecting passage 260 to the inside of the first water supply container 220 to pass through the container connecting part 202.

A first filter 222 may be disposed inside the first water supply container 220 to filter the water before the water is supplied into the ice making device 100. The first filter 222 is disposed at an end portion of the first suction passage 221. When the pump 250 operates in a state where the first water supply container 220 is installed, the water introduced into the connecting passage 260 through the first filter 222 and the first suction passage 221. The water introduced into the connecting passage 260 is supplied into the ice making device 100 through the water supply passage 70.

The second water supply container 231 and the third water supply container 233 are detachably disposed on the housing 210 adjacent to the first water supply container 220. The second water supply container 231 and the third water supply container 233 may be screwed to the container connecting part 202. It denotes that a screw thread formed on an outer circumference surface of an opening of a portable plastic water bucket that is generally available everywhere is screw-coupled to the container connecting part 202.

Although two water supply containers 231 and 233 are coupled as illustrated in FIG. 3, the present disclosure is not limited thereto. For example, one water supply container or three or more water supply containers may be provided according to a required supply amount of the water.

The housing 210 may have at least one opened surface such that the first, second, and third water supply containers 220, 231, and 233 are easily separated.

A second suction passage 232 and a third suction passage 234 extend in an inward direction of the second water supply container 231 and the third water supply container 233, respectively. The second suction passage 232 and the third suction passage 234 guide the water within the second water supply container 231 and the third water supply container 233 to the connecting passage 260, respectively, and are fluidly connected to the connecting passage 260.

A second filter 238 and a third filter 249 are disposed at a lower end of the second suction passage 232 and the third suction passage 234 to purify the water within the second water supply container 231 and the third water supply container 233, respectively.

As described above, since the second water supply container 231 and the third water supply container 233 are provided, a total capacity of the water supply containers 220, 231, and 233 increases to enhance user's convenience.

A water collecting part 240 collecting the water pumped from the second and third water supply containers 231 and 233 is disposed at an upper side of the second water supply container 231 and the third water supply container 233. The water collected in the water collecting part 240 is supplied into the ice making device 100 through the pump 250.

The container connecting part 202 is horizontally disposed such that the water supply containers 220, 231, and 233 are disposed at a lower side thereof. mounting portions 235 through which the second water supply container 231 and the third water supply container 233 detachably pass, respectively, are defined in the container connecting part 202. That is, the mounting portions 235 are holes that are defined in the container connecting part 202. Each of the mounting portions 235 has a predetermined thickness such that the second water supply container 231 and the third water supply container 233 are coupled to the mounting portions 235, respectively. That is to say, a screw thread may be formed on an inner circumference surface of each of the mounting portions 235, and thus is coupled to a screw thread formed on each of outer circumference surfaces of openings of the second and third water supply containers 231 and 232.

The structure in which the second and third water supply containers 231 and 233, the second and third suction passages 232 and 234, and the container connecting part 202 are included, and the second and third water supply containers 231 and 233 are detachably disposed in the housing 210 is called a detachable water supply part 230.

The pump 250 pumping the water from the water supply containers 220, 231, and 233 is disposed in a side of the first water supply container 220. A performance of the pump 250 may be determined in consideration with heights of the water tanks 220, 231, and 233.

A mounting part 251 allowing the pump 250 to be mounted on the housing 210 may be disposed in a side of the pump 250.

The pump 250 is connected to the connecting passage that provides a passage to supply the water from the water supply containers 220, 231, and 233 to the ice making device 100. The connecting passage 260 may be disposed in an upper side of the water supply containers 220, 231, and 233.

In a case where the water supply containers 220, 231, and 233 are installed, the water supply containers 220, 231, and 233 are fluidly connected to the connecting passage 260. That is, the suction passages 221, 232, and 234 are connected to the connecting passage 260, and the water purified by passing through the filters 222, 238, and 239 disposed at the end portions of the suction passages 221, 232, and 234 pass through the suction passages 221, 232, and 234, the connecting passage 260, and the water supply passage 70 in order of precedence, and then is supplied into the ice making device 100.

Figure 4:
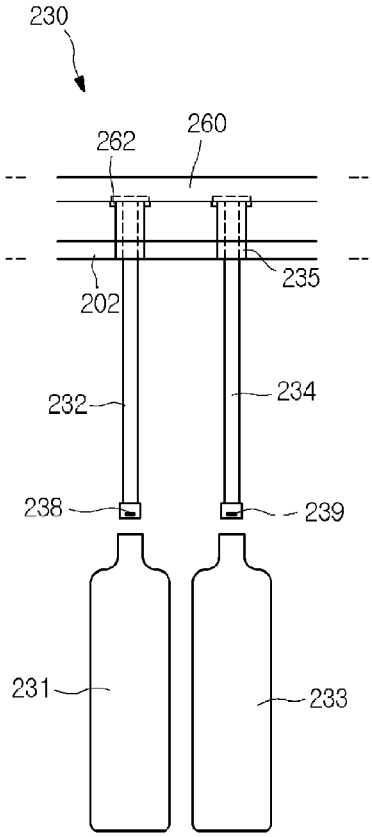
FIG. 4 is an exploded view of a detachable water supply part according to an embodiment.
Figure 5:
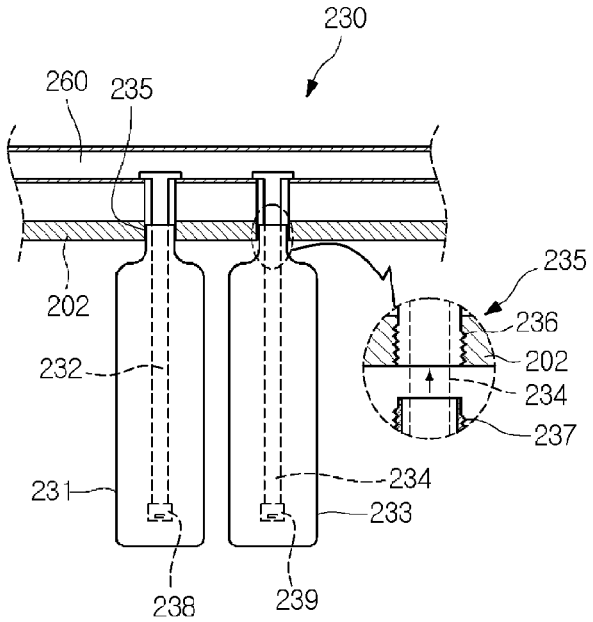
FIG. 5 is a cross-sectional view of a detachable water supply part when a water tank is coupled according to an embodiment.

FIG. 4 is an exploded view of a detachable water supply part according to an embodiment, and FIG. 5 is a cross-sectional view of the detachable water supply part when a water tank is coupled according to an embodiment.

Referring to FIGS. 4 and 5, a detachable water supply part 230 according to this embodiment includes the second and third water supply containers 231 and 233 for storing the water, the second and third suction passages 232 and 234 connected to the connecting passage 260, the second and third filters 238 and 239 disposed at the end portions of the second and third suction passages 232 and 234 to purify the water, and the container connecting part 202 depressed inwardly and coupled to the second and third water supply containers 231 and 233.

In detail, the second and third water supply containers 231 and 233 may be coupled to the mounting portions 235 from a downward direction toward an upward direction of the second and third filters 238 and 239. A portable storage container may be used as the second and third water supply containers 231 and 233. For example, a widely used polyethylene telephthalate (PET) bottle may be used. A second thread screw 237 to be coupled to each mounting portion 235 is formed on each outer circumference surface of the openings of the second and third water supply containers 231 and 232.

The mounting portion 235 is disposed in the container connecting part 202 such that the second and third water supply containers 231 and 233 are coupled. That is, the mounting portion 235 having a hole shape vertically passes through the container connecting part 202. A first thread screw 236 corresponding to the second thread screw 237 is formed on the mounting portion 235.

Thus, the second and third water supply containers 231 and 233 may be screw-coupled to the mounting portion 235. Since the second and third water supply containers 231 and 233 is screw-coupled, the second and third water supply containers 231 and 233 are completely coupled, and thus, it can prevent the water from leaking to the outside.

Also, the second and third suction passages 232 and 234 may pass through the mounting portions 235. The end portions of the second and third suction passages 232 and 234 are coupled in communication with an inner space of the connecting passage 260. A sealing member may be disposed on an outer surface of the connecting passage 260, that is, positions at which the second and third suction passages 232 and 234 are coupled to the connecting passage 260. Due to the sealing member, it prevents the water from leaking from coupling portions of the second and third suction passages 232 and 234 and the connecting passage 260. The second and third suction passages 232 and 234 extend downwardly to pass through the mounting portion 235.

The second and third filters 238 and 239 are disposed at the other sides of the second and third suction passages 232 and 234, respectively, to purify the water stored in the second and third water supply containers 231 and 233 while the water is pumped by the pump 250.

A process in which the water is supplied into the ice making device 100 by the water supply unit 200 according to this embodiment will be simply described.

The first water supply container 220 is installed in the water supply unit 200. Considering an amount of ice to be made, the second water supply container 231 and the third water supply container 233 may be additionally installed. Of course, as further water supply containers may be additionally installed.

The second water supply container 231 and the third water supply container 233 are disposed from a downward direction toward an upward direction of the second suction passage 232 and the third suction passage 234. The openings of the water supply containers 231 and 233 are inserted into the mounting portions 235, respectively. In detail, in a state where the openings of the water supply containers 231 and 233 is inserted into the mounting portions 235, the water supply containers 231 and 233 are spun. As a result, the openings of the water supply containers 231 and 233 are screw-coupled to the mounting portions 235, respectively.

When the pump 250 operates, the water stored in the water supply containers 220, 231 and 233 rises due to a suction force. At this time, the water passes through the filters 222, 238, and 239 and is introduced into the suction passages 221, 232, and 234 to move the water into the connecting passage 260. The water may be supplied into the ice making device 100 through the pump 250 and the water supply passage 70 in series.

In case where the suction force of the pump 250 is applied to the water supply containers 220, 231, and 233, the water may be supplied first into the first water supply container 220 most adjacent to the pump 250 due to the pumping of the pump 250.

The first water supply container 220 may have a shape of an exclusive water supply container provided in refrigerator products. That is to say, the first water supply container 220 may be an exclusive water supply container having a shape and size corresponding to those of the water supply part 200 disposed inside the refrigerator or in the back surface of the refrigerator door. The first water supply container 220 may be defined as a main water supply container, and the second and third water supply containers 231 and 233 may be defined as a sub water supply container, or vice versa. That is to say, the first water supply container 220 may be defined as a sub water supply container, and the second and third water supply containers 231 and 233 may be defined as a main water supply container.

Also, a mineral water bottle having the same shape as the second and third water supply containers 231 and 233 instead of the first water supply container 220 that is the main water supply container for the refrigerator may be provided.

Hereinafter, a control method of a water supply unit including above-described compositions will be described.

Figure 6:
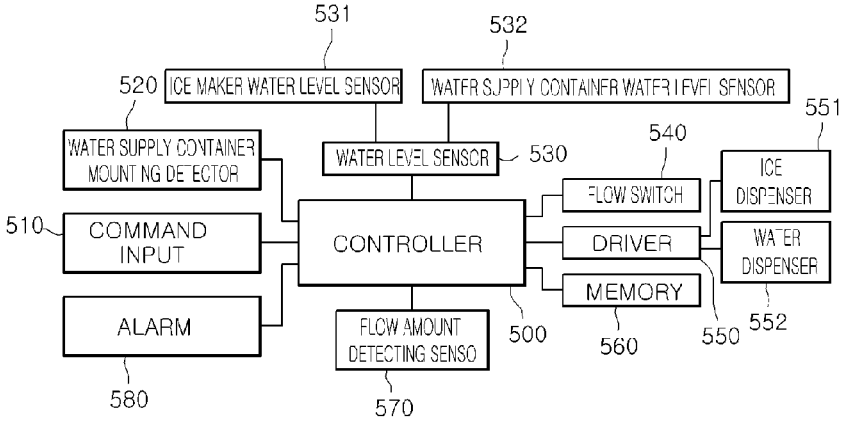
FIG. 6 is a block diagram illustrating a control system of a water supply unit according to an embodiment.

FIG. 6 is a block diagram illustrating a control system of a water supply unit according to an embodiment.

Referring to FIG. 6, a refrigerator control system including a water supply unit according to an embodiment includes a controller 500, a command input 510, a mounting detector 520, a water level sensor 530, a flow switch 540, a driver 550, a memory 560, a flow amount detecting sensor 570, and an alarm 580. The command input 510 inputs various commands into the controller 500. The mounting detector 520 detects whether or not to install or replace each of water supply containers 220, 231, and 233 constituting a water supply unit 200. The water level sensor 530 detects a water level of an ice maker 110 or the water supply container. The flow switch 540 is disposed in a water supply passage connecting an ice making device 110 to the water supply container. The driver 550 performs water supply or ice making The memory 560 stores data supplied with respect to the water level or a flow amount or the other various data. The flow amount detecting sensor 570 detects a flow amount supplied into the ice maker 110. The alarm 580 generates a water supplement signal.

In detail, the command input 510 includes a dispensing button for dispensing ice and a dispensing button for dispensing water. Although a structure for dispensing the water is not described in FIGS. 1 to 5, the present disclosure is not limited thereto. For example, a command input for the dispensing the ice as well as a command input for dispensing the water may be provided.

The mounting detector 520 may be disposed in a side of a container connecting part 202, i.e., a mounting portion 235. Thus, the mounting detector 520 detects whether or not to install or separate the water supply container when the water supply container is installed and separated in/from the mounting portion 235. For example, in a case where a separation signal and an installation signal of the water supply container are generated in order of precedence, it may be programmed to denote that the water supply container is replaced with a new water supply container. A detecting unit that is typically well-known, e.g., a contact sensor may be used as the mounting detector 520.

The water level sensor 530 includes an ice maker water level sensor 531 detecting a level of water to be supplied into the ice maker 110 and a water supply container water level sensor 532 detecting a level of water within the water supply container. A capacitive sensor detecting the water level by detecting a capacitance difference between water and air may be applicable for the water supply container water level sensor 532. In addition, various water level sensors may be applicable.

In detail, the ice maker water level sensor 531 may be disposed on the ice maker, specifically, an ice tray including a plurality of ice cubes. That is, the ice maker water level sensor 531 is disposed on an inside surface of any ice cube, detects the level of the water supplied into the ice maker 110, and determines whether the water supply for making the ice is completed according to the detected water level. In a method for detecting the water level of the water supply container, the water level sensor may be disposed inside each of suction passages 221, 232, and 234 to detect the water level within the water supply container.

The flow switch 540 is a kind of detecting unit for detecting whether the water stored in the water supply container is pumped along the suction passages and a connecting passage 260 when a pump 250 operates. In detail, the flow switch 540 may be disposed inside the connecting passage 260. When the water flows into the connecting passage 260, the flow switch 540 turns on. When the water does not flow into the connecting passage 260, the flow switch 540 turns off. It can determine whether the water within the water supply container exists according to conditions of the flow switch 540.

The driver 550 may include an ice dispenser 551 for dispensing the ice and a water dispenser 552 for dispensing the water. The ice dispenser 551 may include a dispenser 21 and a manipulation lever 22 illustrated in FIG. 1. The water dispenser 552 may include the dispenser 21 and a manipulation lever (not shown) for dispensing the water. That is, the manipulation lever for the water supply may be added around the manipulation lever 2 for dispensing the ice, and the dispenser 21 may be used in common. Since a structure of the dispenser is widely well-known, detail descriptions with respect to the dispenser will be omitted.

The flow amount detecting sensor 570 detects an amount of water supplied into the ice maker 110. The flow amount detecting sensor 570 is provided for achieving the same purpose as that of the ice maker water level sensor 531. That is, when the flow amount detected by the flow amount detecting sensor 570 reaches to a set flow amount for the ice making, the water supply into the ice maker 110 may be stopped. The flow amount detecting sensor 570 may be disposed in an end portion of the water supply passage 70 connected to the ice maker 110. Since a kind of the flow amount detecting sensor 570 applicable to the present disclosure is not limited, a flow amount detecting sensor that is well-known to those skilled in the art may be applied.

The alarm 580 informs water lack or water absence to a user in a case where the water stored in the water supply container lacks or does not exist in a process for supplying the water for the ice making or a process for dispensing drinking water. Thus, the alarm 580 may include a sounder outputting an alarm sound or alarm music, a light emitter, or a character display displaying characters through a liquid crystal panel.

A control system including all of the above described components is included within a scope of the present disclosure, and also, a control system selectively including a portion of the components is included in the embodiments.

For example, in a control system proposed for controlling an operation of the water supply unit 200, there may be proposed a first embodiment in which the ice maker water level sensor 531 is selected as a unit for detecting the flow amount to be supplied into the ice maker 110, and the water supply container water level sensor 532 is selected as a unit for detecting the flow amount of the water supply container.

Also, there may be proposed a second embodiment in which the flow amount detecting sensor 570 instead of the ice maker water level sensor 531 is selected, and a water supply container water level sensor 532 is selected.

Also, there may be proposed a third embodiment in which the flow amount detecting sensor 570 is selected, the flow switch 540 instead of the water supply container water level sensor 532 is selected, and the mounting detector 520 for detecting whether the water supply container is replaced is selected.

Also, there may be proposed a fourth embodiment in which the ice maker water level sensor 531 is selected, and the flow switch 540 and the mounting detector 520 are selected.

Hereinafter, a control method of each of the above proposed embodiments will be described in detail with reference to flowcharts. Prior to this, a control method applicable in common with respect to the first to fourth embodiments will be described with reference to FIG. 7.

Figure 7:
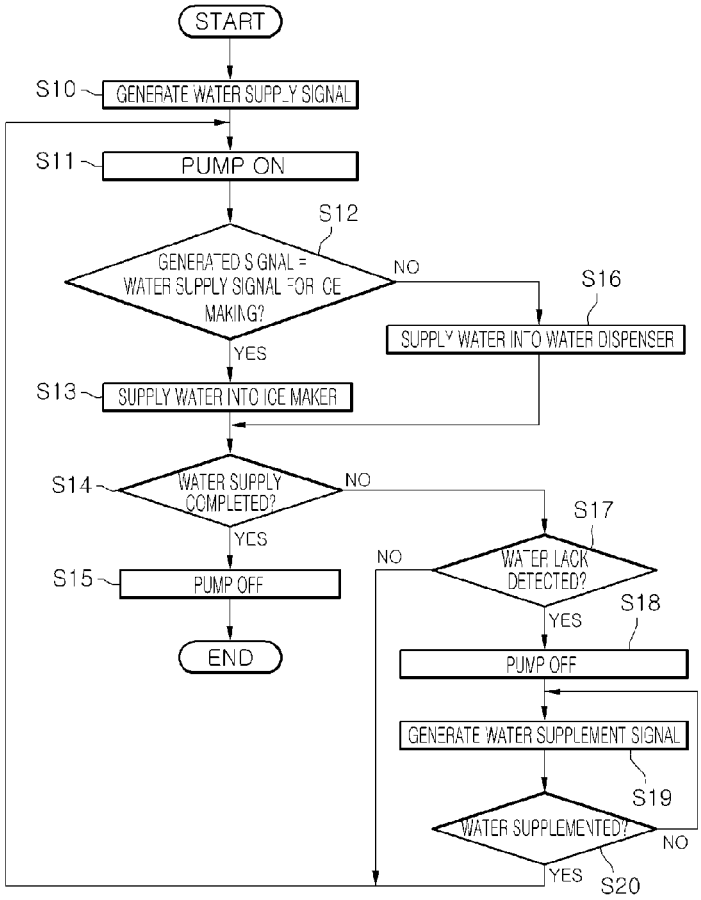
FIG. 7 is a flowchart illustrating a control process of a water supply unit according to an embodiment.

FIG. 7 is a flowchart illustrating a control process of a water supply unit according to an embodiment.

Referring to FIG. 7, a water supply signal is generated to a water supply unit 200 according to an embodiment in operation S10. Here, the water supply signal may be generated by inputting a dispensing command for dispensing drinking water by a user, or a water supply signal for ice making may be automatically generated in the ice making device 100. The command for dispensing the drinking water may be inputted through a manipulation lever for dispensing the drinking water or an input button. The water supply signal for the ice making may be generated by automatically generating an ice making signal in a controller by detecting an amount of ice stored in an ice bank 120.

In operation S11, when the water supply signal is generated, a pump 250 turns on. In operation S12, the signal generated in the controller 500 is analyzed to determine whether the signal is the water supply signal for the ice making or the water supply signal for dispensing the drinking water. In detail, when the generated signal is the water supply signal for the ice making, a valve disposed in a water supply passage connected to an ice maker is opened to supply the water into the ice maker in operation S13. After the time elapsed, the controller determines whether water supply is completed in operation S14. Here, whether the water supply is completed may be determined by the above-described water level sensor or flow amount sensor. When the water supply is completed, the pump 250 turns off in operation S15, and a control operation is finished. On the other hand, in operation S17, the controller 500 determines whether the water stored in the water supply container is lacked in a state where the water supply is not completed. The water lack is detected through the water level sensor disposed in a suction passage of the water supply container or the flow switch disposed in the water supply passage. The water lack denotes a state in which the water within the water supply container is completely drying up, as well as, a state in which the water stored in the water supply container is lowered to a set lower limit level or less than the flow amount. In detail, when the water lack is detected, the pump 250 turns off in operation S18, and a water supplement signal is generated through the alarm 580 in operation S19. When water is supplemented by replacing the water supply container in operation S20, the operations below the operation S11 is repeated. When the water lack is not detected, the pump 250 continuously operates to supply the water. The water supplement signal may be controlled to generate the water supplement signal for a predetermined number of times or a predetermined time or continuously generate the water supplement signal until the water supply container is replaced.

When the controller determines that the generated signal is the water supply signal for dispensing the drinking water, the water is supplied into a water dispenser in operation S16, and the operations below the operation S14 in which the controller determines whether the water supply is completed are repeatedly performed. Here, the water supply completion denotes a case in which the user presses and then removes a manipulation button for dispensing the drinking water to generate a water supply stopping signal. For example, when the user presses the manipulation button using a tool such as a cup, the drinking water dispensing signal may be generated. When the user removes the cup from the manipulation button, the water supply stopping signal may be generated. When the water supply stopping signal is generated to transmit the signal into the controller 500, the controller 50 determines that the water supply may be completed.

In the water supply unit including the above-described control logic, the control methods of the first to fourth embodiments decided according to a combination of a unit for detecting an amount of water to be supplied into the ice maker and a flow amount detecting unit disposed in the water supply container will now be described in detail with reference to flowcharts. Embodiments described below are limited in a case where the water supply signal for the ice making is generated.

Figure 8:
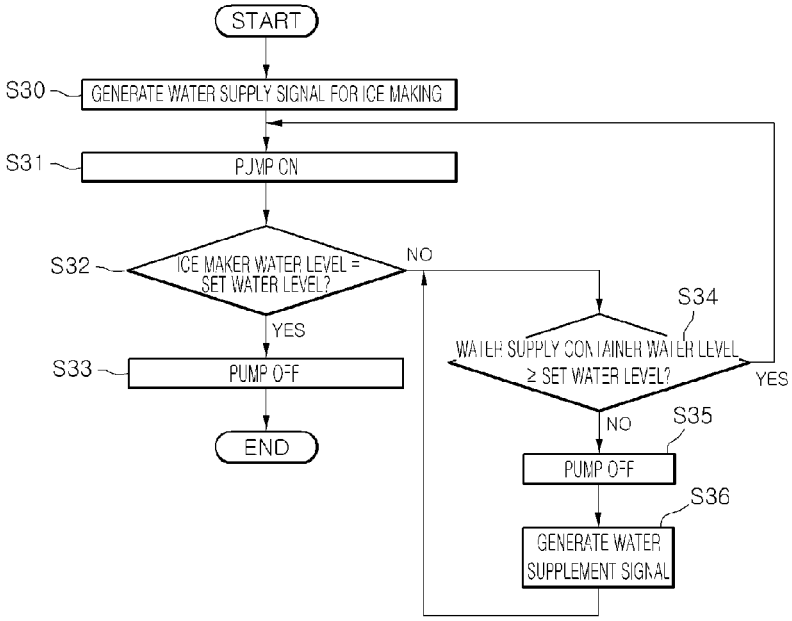
FIG. 8 is a flowchart illustrating a control process of a water supply unit according to a first embodiment.

FIG. 8 is a flowchart illustrating a control process of a water supply unit according to a first embodiment.

As described above, according to a first embodiment, water level sensors are disposed on an ice maker 110 and a water supply container, respectively.

Referring to FIG. 8, when a water supply signal for ice making is generated in operation S30, a pump 250 turns on in operation S31. A controller 500 receives data of a water level from an ice maker water level sensor 531 disposed in an ice tray of an ice maker 110. In operation S32, the controller 500 determines whether the water level of the ice maker 110 reaches to a set water level.

When the controller 500 determines that the ice maker water level reaches to the set water level, the pump 250 turns off in operation S33, and a water supply control is finished. On the other hand, when the ice maker water level does not reach to a set water level, the controller receives data of a water level of a water supply container from a water supply container water level sensor 532 disposed in a suction passage of the water supply container. In operation S34, the controller 500 determines whether the water level of the water supply container is higher than the set water level. Here, the set water level of the water supply container may be set to zero or a predetermined water level less than a maximum water level of the water supply container. When the controller 500 determines that the water supply container water level is greater than the set water level, water is continuously supplied. When the controller 500 determines that the water supply container water level is less than the set water level, the pump 250 turns off in operation S35. In operation S36, a water supplement signal is generated through an alarm 580.

The water supplement signal generation and the water supply container water level detection are performed repeatedly at a fixed cycle. The water supplement signal may be continuously outputted until the water supply container water level is greater than the set water level.

A case in which it determines that the water supply container water level is greater than the set water level after the water supplement signal is generated denotes that the user replaces the water supply container with a new water supply container. When the water supply container water level is greater than the set water level due to the water supply container replacement, the pump 250 turns on, the operations (below the operation S31) in which the water is supplied are repeatedly performed.

Figure 9:
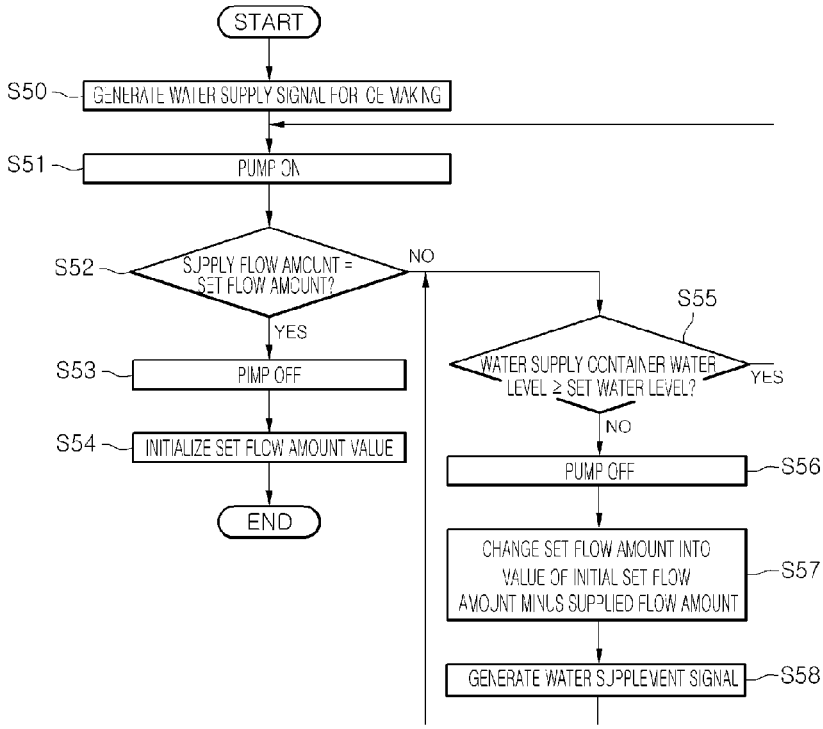
FIG. 9 is a flowchart illustrating a control process of a water supply unit according to a second embodiment.

FIG. 9 is a flowchart illustrating a control process of a water supply unit according to a second embodiment.

As described above, according to a second embodiment, a flow amount detecting sensor 570 is disposed in an ice maker 110, and a water supply container water level sensor 532 is disposed in a suction passage of a water supply container.

Referring to FIG. 9, when a water supply signal for ice making is generated in operation S50, a pump 250 turns on in operation S51. In operation S52, a controller 500 determines whether a flow amount of water supplied into an ice maker reaches to a set flow amount. In detail, the flow amount supplied into the ice maker is detected by a flow amount detecting sensor 570, the detected flow amount data is transmitted into the controller 500.

When the controller 500 determines that the supply flow amount reaches to the set flow amount, the pump 250 turns off in operation S53. After a set flow amount value is initialized to an initial set flow amount value in operation S54, a supply control is finished. Here, the set flow amount value is initialized because the set flow amount is changed in a case where water lack occurs before the supply flow amount reaches to the set flow amount.

In detail, the controller 500 periodically determines whether the water supply container water level is greater than the set water level in operation S55 before the supply flow amount reaches to the set flow amount. That is to say, the water supply container water level is detected by a water level sensor disposed in a suction passage of the water supply container, the detected water level data is transmitted to the controller. When the controller determines that the water supply container water level is less than the set water level before the water supply is completed, the pump 250 turns off in operation S56. Here, similar to the first embodiment, the set water level of the water supply container may be set to zero or a predetermined water level less than a maximum water level of the water supply container. The pump 250 turns off, and the set flow amount value is changed at the same time or in order of precedence. For example, a value of the initial set flow amount minus the previously supplied flow amount is automatically set to the changed set flow amount in operation S57. In operation S58, a water supplement signal is generated through an alarm 580. Even if the water supplement signal is generated, the controller periodically detects the water supply container water level. When the controller determines that the water supply container water level is greater than the set water level, the pump 250 turns on to start the water supply process (below the operation S51). Here, a case in which the water supply container water level is greater than the set water level denotes that the user replaces the water supply container with a new water supply container.

Figure 10:
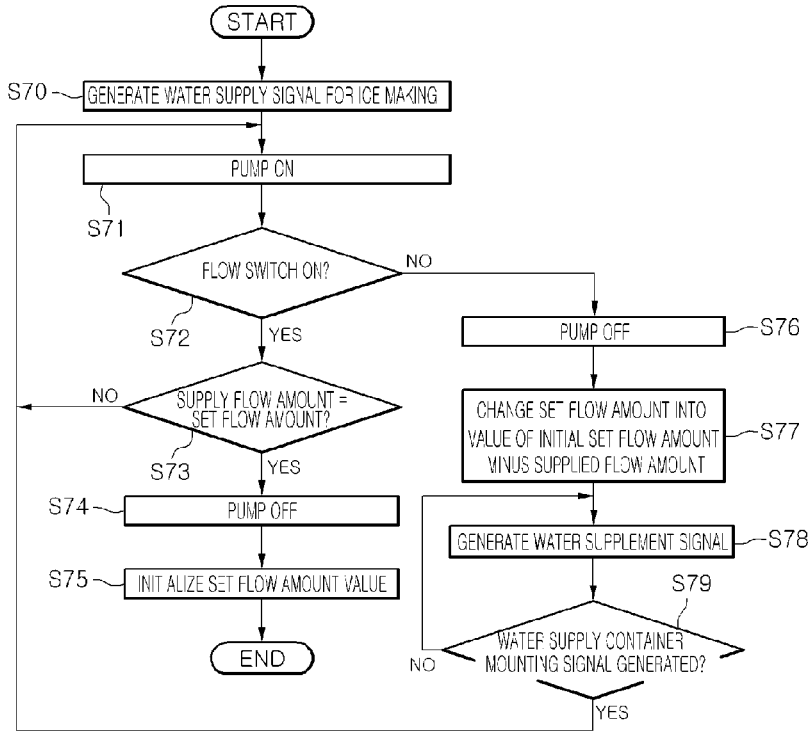
FIG. 10 is a flowchart illustrating a control process of a water supply unit according to a third embodiment.

FIG. 10 is a flowchart illustrating a control process of a water supply unit according to a third embodiment.

As described above, according to a third embodiment, a flow amount detecting sensor 570 is disposed in an ice maker 110, a flow switch 540 is disposed in a water supply passage including a connecting passage 260, and a mounting detector 520 is disposed in a container connecting part 202.

Referring to FIG. 10, when a water supply signal for ice making is generated in operation S70, a pump 250 turns on in operation S71. In operation S72, a controller 500 determines whether the flow switch turns on. In detail, when the controller determines that the flow switch turns on, the controller determines whether a flow amount supplied into an ice maker 110 reaches to a set flow amount in operation S73. To turn on the flow switch denotes that water was stored in the water supply container. When the controller determines that the flow amount supplied into the ice maker reaches to the set flow amount, the pump 250 turns off in operation S74. Thereafter, the set flow amount is initialized to an initial value in operation S75. To initialize the set flow amount was described in the second embodiment of FIG. 9. When the supply flow amount does not reach to the set flow amount, the water is continuously supplied into the ice maker.

The controller determines that the flow switch is maintained in a turn-off state, the pump 250 turns off in operation S76, and the set flow amount is changed. That is, a value of the initial set flow amount minus the previously supplied flow amount is changed to a changed set flow amount in operation S77. In operation S78, a water supplement signal is generated through an alarm 580.

When the water supplement signal is generated, the controller determines whether a water supply container mounting signal is generated in operation S79.

In detail, since the flow switch is used for determining whether water remains in the water supply container, an additional device is required for determining whether the water supply container is replaced. Thus, a detecting sensor is disposed inside a mounting portion 235 of the container connecting part 202 to generate a detecting signal when the water supply container is inserted into the mounting portion 235 or separated from the mounting portion 235. When a separation signal and a mounting signal are generated in the mounting detector 520 in order of precedence, it may be programmed to determine that the water supply container is replaced with a new water supply container.

Thus, when the water supply container mounting signal is generated after the water supplement signal is generated, the controller determines that the water supply container is replaced with the new water supply container to repeatedly perform the operations (below the operation S71) in which the pump turns on to supply the water. On the other hand, when the water supply container mounting signal is not generated, the water supplement signal may be continuously generated. Here, to generate the water supply container mounting signal denotes that the water supply container separation signal and the water supply container mounting signal are generated with a predetermined time period in order of precedence.

After the water supply container is replaced with the new water supply container, the set flow amount value is replaced with the changed flow amount value to supply the water until the newly supplied flow amount reaches up to the changed flow amount. Then, the initial set flow amount, that is, a flow amount required for ice making is supplied into the ice maker 110.

Figure 11:
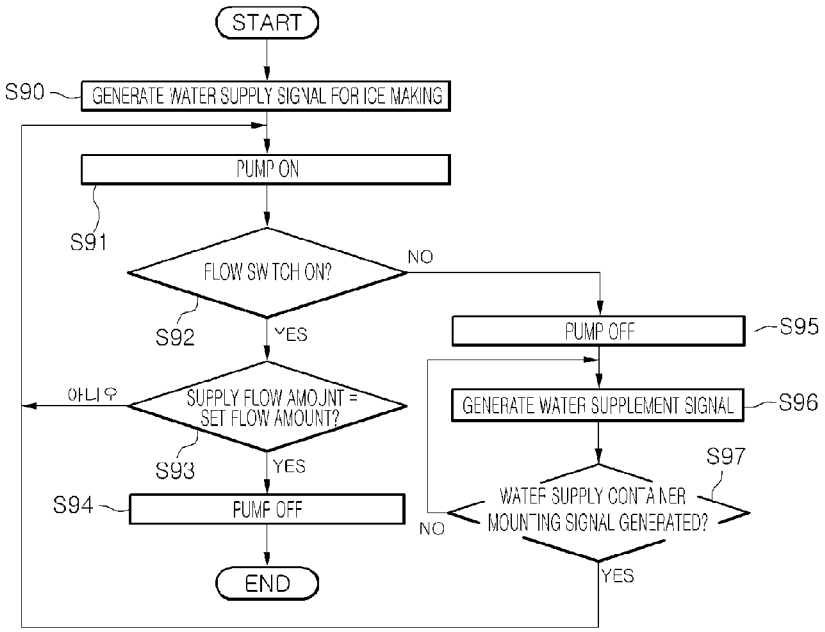
FIG. 11 is a flowchart illustrating a control process of a water supply unit according to a fourth embodiment.

FIG. 11 is a flowchart illustrating a control process of a water supply unit according to a fourth embodiment.

As described above, according to a fourth embodiment, an ice maker water level sensor 531 is disposed in an ice maker 110, a flow switch 540 is disposed in a water supply passage including a connecting passage 260, and a mounting detector 520 is disposed in a container connecting part 202.

Referring to FIG. 11, operations (operation S90 to operation S92) for determining whether a water supply signal for ice making is generated, a pump turns on, and a flow switch turns on have the same operation as the third embodiment of FIG. 10.

When the flow switch turns on, an ice maker water level is detected by an ice maker water level sensor 531, and data of the detected water level is transmitted to a controller 500. In operation S93, the controller 500 determines whether the detected water level reaches to a set water level. When the controller 500 determines that the detected water level reaches to the set water level, the pump turns off in operation S94, and a control is finished. On the other hand, when the ice maker water level does not reach to the set water level, the water is continuously supplied into the ice maker.

In spite of turning on the pump, when the controller determines that the flow switch 540 turns off, it denotes that the water lacks or absent in the water supply container. Thus, the pump 250 turns off in operation S95. When the pump 250 turns off, a water supplement signal is generated through an alarm 580 in operation S96 at the same time or in order of precedence. In operation S97, the controller determines whether the water supply container mounting signal is generated through the mounting detector 520. Whether the water supply container mounting signal is generated was described in the third embodiment of FIG. 10. In detail, when the water supply container mounting signal is generated, the controller determines that the water supply container is replaced with the new water supply container to turn on the pump again, thereby starting the water supply process (below the operation S91) again.

In the control methods according to the above proposed embodiments, the water stored in the water supply container is supplied into the ice making device 100, and the alarm signal is generated in the case where the water does not exist in the water supply container. Then, the water supply container is replaced, and the water supply starts again to smoothly perform the ice making.

The invention claimed is:

1. A refrigerator comprising:

a controller;

an ice making device disposed in a storage space of the refrigerator or a door shielding the storage space;

a water supply container detachably disposed in the storage space or the door;

a container connecting part to which an outlet opening part of the water supply container is coupled, the outlet opening of the container configured to be directed upwardly when the water supply container is coupled to the container connecting part;

a water supply passage fluidly connecting the water supply container to the ice making device, one end of the water supply passage extending to the ice making device and the other end of the water supply passage extending to an inside of the water supply container;

a detecting unit disposed in the ice making device to determine whether a set flow amount of water is supplied into the ice making device; and a unit disposed inside or outside the water supply container to determine whether water remains in the water supply container.

2. The refrigerator according to claim 1, further comprising a mounting detector disposed inside the container connecting part to detect whether the water supply container is mounted to or dismounted from the container connecting part.

3. The refrigerator according to claim 1, further comprising an alarm that informs replacement time or water supplement time of the water supply container.

4. The refrigerator according to claim 1, wherein the detecting unit comprises a water level sensor for detecting a water level of the water supplied into the ice making device.

5. The refrigerator according to claim 1, wherein the detecting unit comprises a flow amount detecting sensor for detecting a flow amount of the water supplied into the ice making device.

6. The refrigerator according to claim 1, wherein the unit disposed inside the water supply container comprises a water level sensor disposed in the water supply passage extending into the water supply container to detect a water level within the water supply container.

7. The refrigerator according to claim 1, wherein the unit disposed outside the water supply container comprises a flow switch disposed in the water supply passage to detect a water flow.

* * * * *